US006157135A

United States Patent [19]

Xu et al.

[11] Patent Number: 6,157,135

[45] Date of Patent: Dec. 5, 2000

[54] HALOGEN LAMP WITH HIGH TEMPERATURE SENSING DEVICE

[76] Inventors: Zhiwei Xu, 3235 Armstrong St. Apt. A-20, San Diego, Calif. 92111; Peisheng Qian, 2255 Yue Luo Rd., Shanghai, China, 201908

[21] Appl. No.: 09/232,358

[22] Filed: Jan. 15, 1999

Related U.S. Application Data

[60] Provisional application No. 60/104,714, Oct. 19, 1998.

[51] Int. Cl.[7] ..... H01J 7/24

[52] U.S. Cl. ..... 315/118; 315/104; 315/158; 362/410; 362/418

[58] Field of Search ..... 315/118, 119, 315/158, 104; 362/248, 410, 418, 376; 250/214 AL

[56] References Cited

U.S. PATENT DOCUMENTS

| | | | |
|---|---|---|---|
| 2,027,405 | 1/1936 | Smede | 219/20 |
| 2,105,430 | 1/1938 | Metcalf | 176/16 |
| 2,166,685 | 7/1939 | Henderson et al. | 250/27 |
| 2,412,907 | 12/1946 | Pennow | 315/116 |
| 3,731,247 | 5/1973 | Levinn | 337/140 |
| 3,779,078 | 12/1973 | Kaesser et al. | 73/343 R |
| 4,101,807 | 7/1978 | Hill | 315/116 |
| 4,450,512 | 5/1984 | Kristofek | 362/276 |
| 4,508,993 | 4/1985 | Anderson | 315/59 |
| 4,518,895 | 5/1985 | Lehman | 315/117 |
| 4,533,853 | 8/1985 | Hammond et al. | 315/117 |
| 4,694,223 | 9/1987 | Campolo | 315/118 |
| 4,751,623 | 6/1988 | Gaines et al. | 362/276 |
| 4,789,810 | 12/1988 | Ottenstein | 315/308 |
| 4,965,484 | 10/1990 | Fein | 313/15 |
| 5,073,846 | 12/1991 | Lin | 362/263 |
| 5,077,645 | 12/1991 | Habinak | 362/226 |
| 5,095,247 | 3/1992 | Hanamura | 315/111.21 |
| 5,101,142 | 3/1992 | Chatfield | 315/308 |
| 5,274,305 | 12/1993 | Bouchard | 315/108 |
| 5,381,509 | 1/1995 | Mills | 392/376 |
| 5,568,586 | 10/1996 | Junkel | 392/376 |
| 5,720,549 | 2/1998 | Lavy | 362/378 |
| 5,733,038 | 3/1998 | Wang | 362/394 |
| 5,800,052 | 9/1998 | Yeh | 362/376 |
| 5,801,490 | 9/1998 | Fai | 315/118 |
| 5,808,418 | 9/1998 | Pitman et al. | 315/115 |
| 5,863,111 | 1/1999 | Turner et al. | 362/410 |
| 5,870,900 | 2/1999 | Mohebbi et al. | 62/187 |
| 5,902,037 | 5/1999 | Turner et al. | 362/376 |

OTHER PUBLICATIONS

Therm–O–Disc Special Purpose Temperature Controls home page on the World Wide Web.

*Primary Examiner*—Haissa Philogene

*Attorney, Agent, or Firm*—Dobrusin Darden Thennisch & Lorenz PLLC

[57] ABSTRACT

A lighting device including a temperature sensing device for controlling the operation of the light emitting device. The lighting device includes a housing, a reflector coupled to the housing, a bulb received in the housing, the bulb being connected to a source of electrical power, and a capillary tube thermostat received in the housing. The capillary tube is an elongated metal member having a hollow center filled with a vacuum charged fluid. The fluid is calibrated to open the thermostat between 150° F. and 350° F. The capillary tube thermostat is in electrical communication with the power source and is supported by the housing in thermal communication with the bulb. The thermostat extends along at least a portion of the length of the bulb. The thermostat is also in thermal communication with the reflector, and thus will open the thermostat contacts if an overheat condition is detected at either the bulb or the reflector.

17 Claims, 3 Drawing Sheets

HALOGEN LAMP WITH HIGH TEMPERATURE SENSING DEVICE

CROSS-REFERENCE

This application claims priority to the provisional patent application for a HALOGEN LAMP WITH HIGH TEMPERATURE SENSING DEVICE filed on Oct. 19, 1998, and assigned application Ser. No. 60/104,714.

FIELD OF THE INVENTION

The present invention relates generally to a lighting device. More particularly, the invention relates to a lighting device having a temperature sensor for controlling the operation of the device.

BACKGROUND OF THE INVENTION

Light emitting sources used in conventional lighting devices may reach high levels of heat intensity. In some circumstances, the heat intensity may be high enough to ignite flammable materials that come into contact with the light emitting source. One such light emitting source is the halogen torchiere bulb.

Typically the halogen torchiere lamp 10 includes a supporting member 12, a housing 14, a bulb 16 and a reflector 18. As illustrated in FIG. 1, the housing 14 includes an upwardly extending U-shaped surface supported by the supporting member 12. The housing 14 supports the bulb 16. Generally, the bulb 16 extends horizontally along the housing 14, and normally has electrical contacts at opposing ends. Each end of the bulb 16 supporting the electrical contacts is received in a socket 24, the socket 24 supporting mating terminal contacts for electrically coupling the bulb 16 to a power source 36, typically, via an on-off switch 38. The socket 24 is coupled to the housing 14 using known techniques such as spot welding or mechanical fasteners.

The housing 14 also supports the reflector 18. In some prior art devices, the housing 14 and the reflector 18 are fabricated as a single unit. If the housing 14 and reflector 18 are separate components, the reflector 18 is positioned in the housing 14 so as to direct the light from the bulb 16 out of the housing 14. Typically a portion of the reflector 18 extends beneath the bulb 16, as illustrated in FIG. 1. Additionally, the housing 14 supports a barrier member or guard 42 that prevents objects from falling into the housing 14 and contacting the bulb 16, shield 40 or reflector 18, and the bulb 16 is covered by a protective shield 40 to prevent inadvertent contact with the bulb 16.

As reported in one news article, halogen bulbs tend to burn much hotter than incandescent and fluorescent bulbs. Halogen bulbs have been known to reach temperatures in excess of approximately 700° F. Consequently, if the halogen bulb comes into contact with cloth, paper or other combustibles, these materials may be ignited.

Many modern designs for the halogen lamp incorporate devices for regulating the operation of the halogen bulb. U.S. Pat. No. 5,733,038 describes one such regulating device. The device includes a sensor mounted on the reflector for generating a sensor light signal corresponding to the light intensity detected by the sensor. The sensor is electrically connected to a control circuit, which interconnects the lamp and a power source. The control circuit is capable of disconnecting the lamp from the power source upon detection that the sensor light signal has reached a level indicative of a condition that the reflector is covered by an object. The disclosed regulator does not measure temperature increases that may occur in the bulb due to malfunction or partial covering.

U.S. Pat. No. 5,801,490 (hereinafter the '490 patent) describes another regulating device. The device disclosed includes a temperature sensor installed on the reflector, near the midpoint of the bulb. The temperature sensor comprises a thermostat electrically coupled to the lamp's electrical circuitry and a half-cylindrical mask. The mask prevents direct illumination of the thermostat body by the bulb, and the thermostat de-energizes the bulb when the sensed ambient temperature reaches a predetermined temperature.

Under certain circumstances, hot spots may develop in the lamp at locations distant from the midpoint of the bulb. This occurrence has been the cause of great concern with respect to potential fire hazards associated with halogen lamps. As a result, the Underwriter's Laboratories, Inc. (UL), a widely recognized, independent, not-for-profit, testing organization, has implemented a safety standard designed to test for hot spots as various points relative to the axis of the bulb.

The "lamp containment barrier" test, Standard 112, becomes effective Jun. 1, 1999. In this test, the lamp is placed in a draft-free room and connected to a variable 120-volt power supply, and adjusted to produce the rated lamp wattage. The lamp is left in the "on" condition for 15 minutes. Without being compressed, a specially prepared cheesecloth pad is placed on top of the lamp so that the cheesecloth is centered along the axis of the bulb. The cheesecloth pad is positioned on the lamp such that the cheesecloth follows the contour of the guard. As a result, the cheesecloth extends over the edges of the guard at both ends, and is as close to the bulb as the lamp's construction permits. The lamp is to be operated until (a) the cheesecloth ignites (flames); (b) a hole develops in any layer of the cheesecloth; or (c) seven hours has elapsed. To successfully pass the test, there shall be no (a) ignition (flaming) of the cheesecloth; or (b) holes developed in any layer of the cheesecloth fabric due to elevated temperatures.

For lamps including an automatic temperature regulating or limiting control, the test is repeated with the cheesecloth positioned at 90 degrees with respect to the axis of the bulb and in any other position that results in a longer time for the control to operate. The test is then repeated with the cheesecloth in the position that resulted in the longest time for the control to operate, with the unit's wattage reduced in 50 watt increments for dimmers that are continuous by changing the input voltage, or selecting a lower step wattage setting for dimmers that are not continuous, until the unit operates for seven hours without operation of the control device.

To satisfy some barrier containment tests, a high temperature limiting sensor capable of detecting localized hot spots that may develop at remote locations along the bulb or within the reflector is needed. There is also a need for a simplified sensor that permits sensing a temperature and de-energizing the lamp without the use of electric sensing components.

SUMMARY OF THE INVENTION

The present invention is directed to a lighting device including a temperature sensing device for controlling the operation of the light emitting device. The lighting device includes a housing, a reflector coupled to the housing, a bulb received in the housing, the bulb being connected to a source of electrical power, and a capillary tube thermostat received in the housing. The lighting device also includes a shield that covers the bulb, and a guard that extends across the bulb to prevent flammable materials from contacting the reflector, shield or the bulb.

The capillary tube thermostat is in electrical communication with the power source and disrupts power to the lamp if a predetermined temperature is reached. The capillary tube thermostat is an elongated metal tube placed in thermal communication with the bulb, such that the thermostat extends along at least a portion of the length of the bulb. The thermostat is also in thermal communication with the reflector, and thus will open the thermostat contacts if an excessive temperature is detected in the housing, particularly in the vicinity of either the bulb or the reflector.

The center of the capillary tube is filled with a vacuum charged fluid. The fluid is calibrated to open the thermostat between 150° F. and 350° F. The tube is vacuum sealed to prevent ambient temperatures and pressures from interfering with the operation of the capillary tube thermostat.

The thermostat used may be manually resettable, whereby the lighting device must be disconnected from the power source and reconnected, or the thermostat may be manually reset by depressing a reset button to reestablish a connection to the electrical power source by manually closing the open contacts. However, power is restored to the bulb only if the temperature in the housing has dropped below a preselected temperature. Alternatively, the thermostat used may be an automatic reset type, whereby power is automatically restored to the bulb once the temperature in the housing drops below a predetermined value.

BRIEF DESCRIPTION OF THE DRAWINGS

The features and inventive aspects of the present invention will become more apparent upon reading the following detailed description, claims and drawings, of which the following is a brief description:

DETAILED DESCRIPTION

Figure 1:
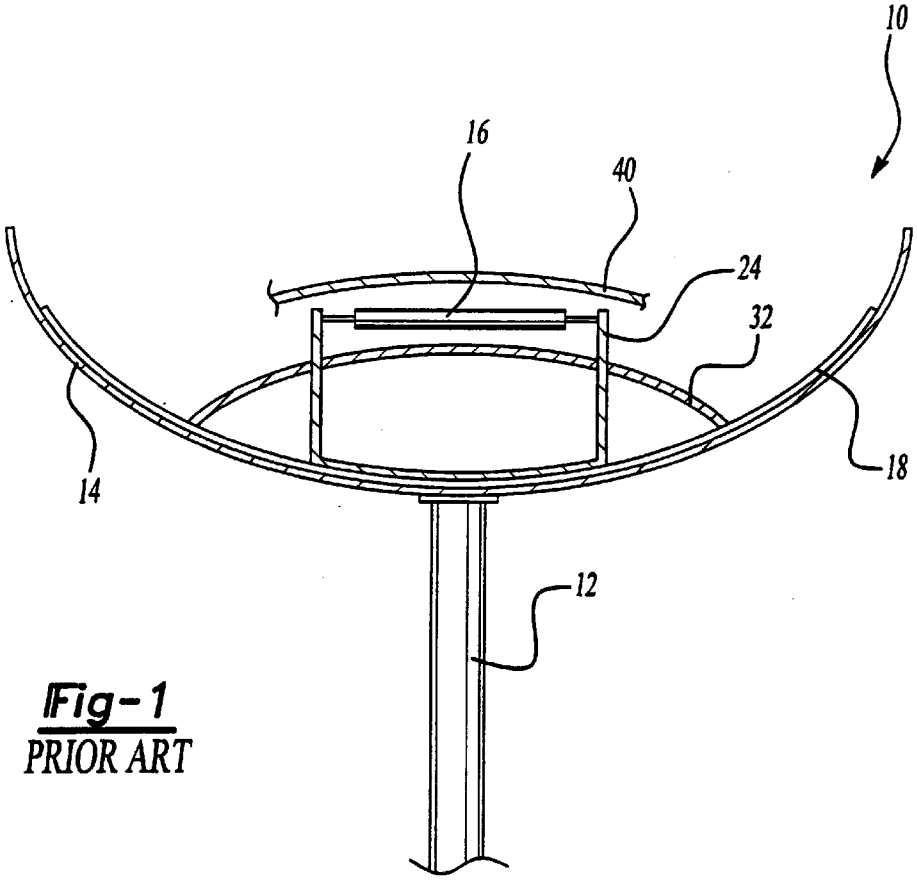
Fig-1 PRIOR ART
FIG. 1 is a front elevational view showing a sectional view of a prior art lighting device.
Figure 2:
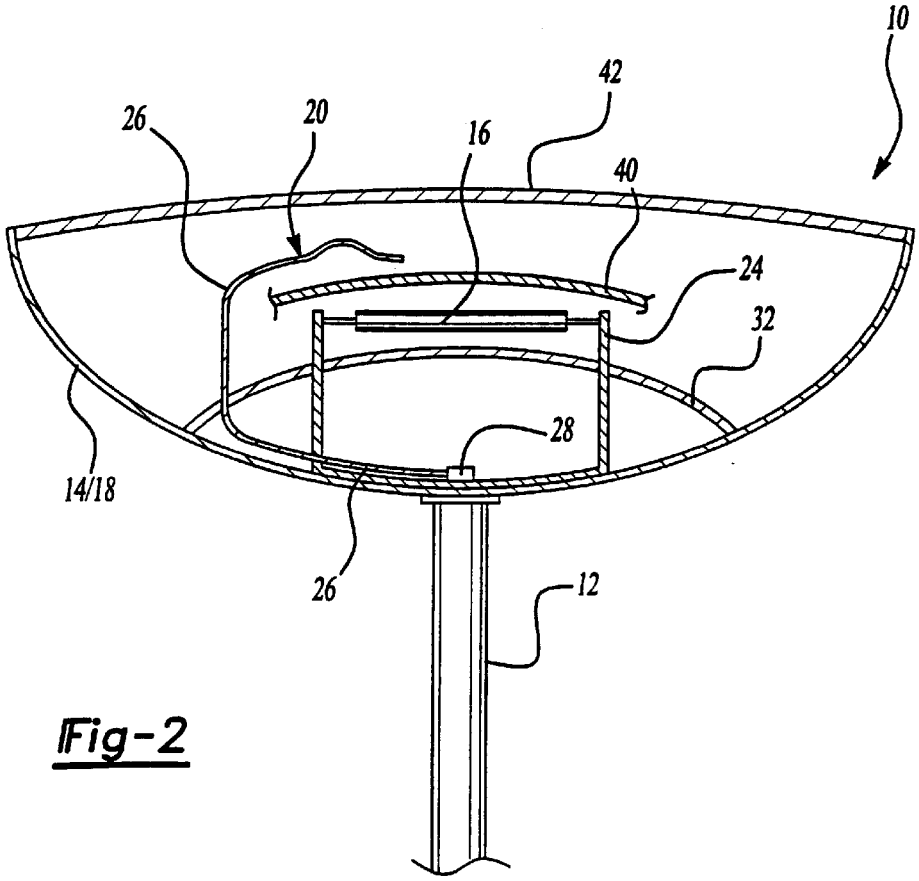
FIG. 2 is a front elevational view showing a sectional view of a lighting device formed in accordance with the teachings of the present invention having an upwardly extending housing.
Figure 3:
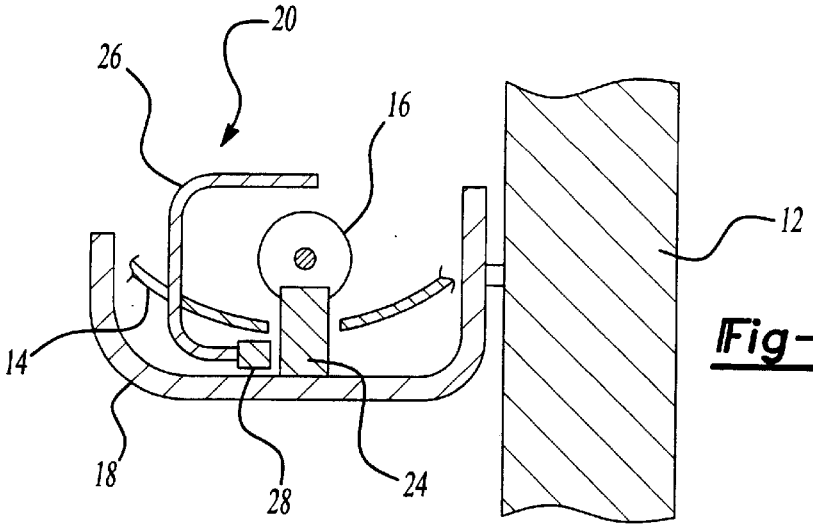
FIG. 3 is an elevational view of another embodiment of the invention, wherein the housing is supported by a structural support member.
Figure 4:
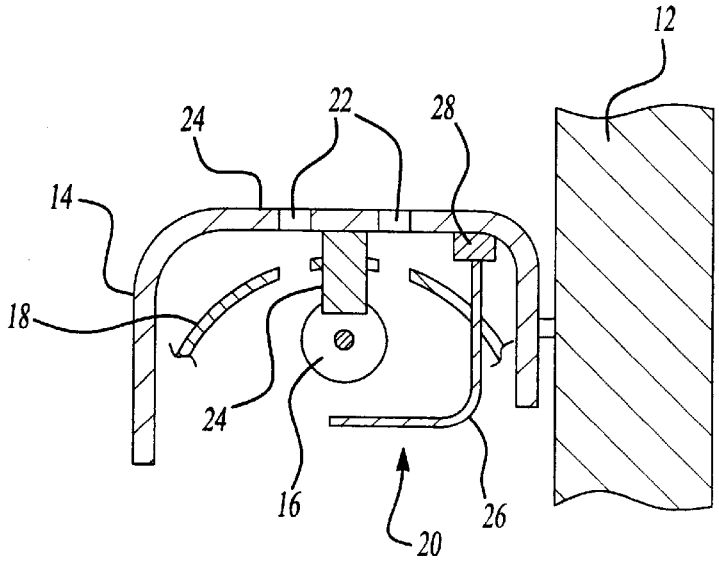
FIG. 4 is an elevational view showing a sectional view of a lighting device shown in FIG. 3 having a downwardly extending housing.
Figure 5:
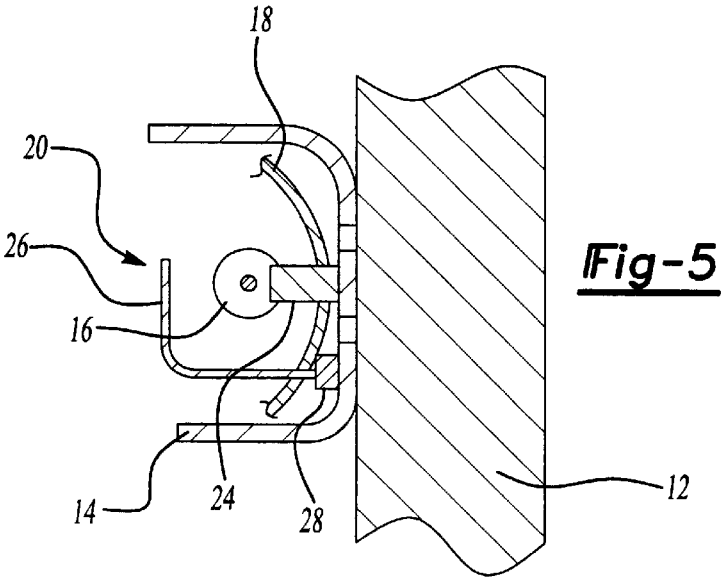
FIG. 5 is an elevational view showing a sectional view of a lighting device shown in FIG. 4 having a horizontally extending housing.

The lighting device is a halogen lamp 10. The embodiment of the halogen lamp 10 shown in FIGS. 1–8 includes common elements. It will be understood that common reference numerals are used to describe common features of the embodiment of the halogen lamp shown in FIGS. 1–8. As shown in FIGS. 2–7, the lamp 10 formed in accordance with the teaching of this invention includes a supporting member 12, a housing 14, a bulb 16, a reflector 18, and a capillary tube thermostat 20. As described above, these elements are assembled using known techniques to form the lamp 10.

Figure 6:
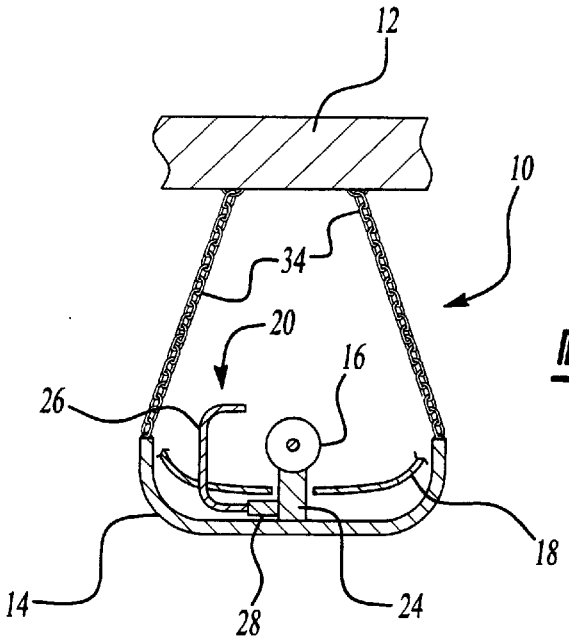
FIG. 6 is an elevational view showing a sectional view of a lighting device shown in FIG. 3 having an upwardly extending housing suspended from a structured supporting member.

The supporting member 12 supports the housing 14 directly as shown in FIGS. 1–5 or indirectly as shown in FIG. 6, wherein a suspension member 34 couples the housing 14 to the supporting member 12. The supporting member 12 may be a rod, a wall, floor, ceiling or other structural member.

As illustrated in FIGS. 1–7, the housing 14 may be coupled to the supporting member 12 in various orientations, e.g., the housing 14 extending upwards, downwards or sideways. Additionally, the housing 14 includes openings 22, which provide an additional pathway for heat built-up inside the housing 14 to escape. As the primary path for heat dissipation is through the open portion of the housing 14, the openings 22 may be omitted.

The capillary tube thermostat 20 is received in the housing 14, and includes a capillary tube 26 filled with a fluid under pressure, a switch housing 28, switch contacts 30 and a diaphragm (not shown). The capillary tube 26 is a thin elongated metal tube having a high coefficient of heat transfer. It will be appreciated that nonmetal materials having heat conductive properties similar to metals may be used to construct the capillary tube 26.

The capillary tube 26 is placed in the vicinity of the bulb 16 in a manner that permits detection of a temperature increase in the housing 14, with particular emphasis on sensing temperature increases near the bulb 16 and the reflector 18. Generally, conductive and radiant heating of the capillary tube 26 are insignificant and pose little concern due to the tube's 26 small diameter.

Figure 7:
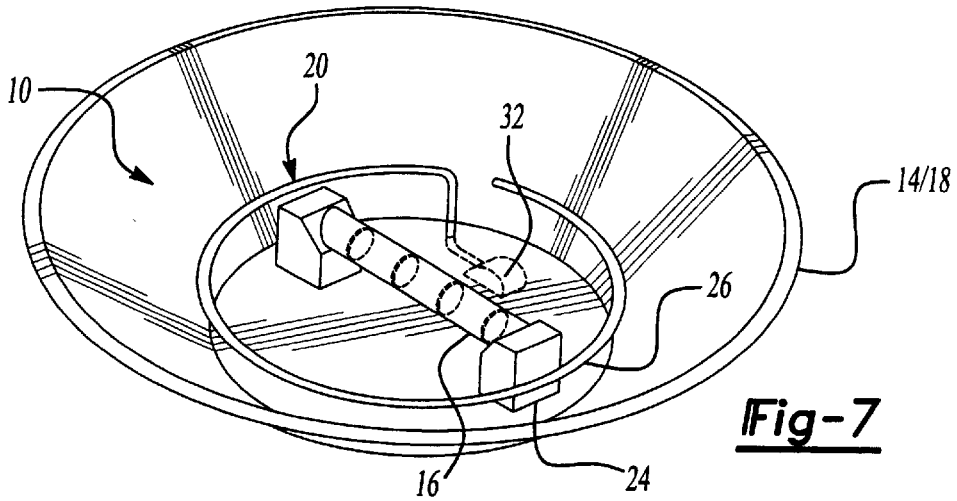
FIG. 7 is a top view showing a lighting device formed in accordance with the teachings of the present invention having a capillary tube thermostat bent in a circular pattern.

As shown in FIG. 7, the capillary tube 26 is placed in a circular configuration above bottom surface of the reflector 18 and the adjacent bulb 16. The capillary tube 26 is positioned so as to encircle the bulb 16. This arrangement approximates two-dimensional temperature sensing. Here, temperature rises within the housing 14, particularly in the vicinity of the bulb 16 and the reflector 18, are sensed from at least two locations for each point along the axis of the bulb 16 located within the loop formed by the capillary tube thermostat 20. FIGS. 1–6 show another configuration of the capillary tube thermostat 20, wherein the capillary tube 26 extends linearly along at least a portion of the length of the bulb 16.

The switch housing 28 retains the diaphragm (not shown) and supports the switch contacts 30 at the housing's 28 outer surface. The diaphragm is retained in the switch housing 28 in a manner that permits the diaphragm to cause the activation of the switch contacts 30 and the disruption of power to the lamp 10 (discussed below).

The switch contacts 30 are electrically coupled to the electrical circuitry supplying power to the bulb 16 using known techniques. An electrical wiring housing 32 supported by the housing 14 retains the electrical connections for both the lamp 10 and the capillary tube thermostat 20.

OPERATION

Figure 8:
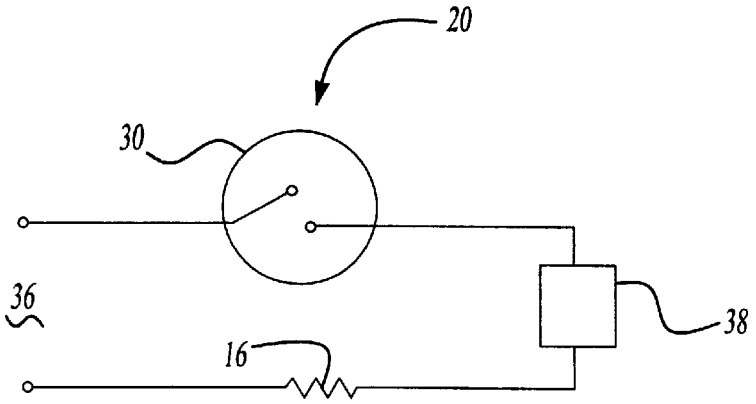
FIG. 8 is a schematic showing a wiring diagram for the lighting device shown in FIG. 1.

As illustrated in FIG. 8, the capillary tube thermostat 20 is connected in electrical series with the bulb 16 and the on/off switch 38. The capillary tube thermostat 20 contains no live electrical sensing parts for detecting a rise in temperature. Instead, the capillary tube thermostat 20 is a hollow elongated metal member, wherein the hollow center is filled with a fluid under pressure.

In the preferred embodiment, the capillary tube thermostat 20 is vacuum charged with selected fluids to give specific calibrations. When the fluid inside the capillary tube 26 reaches a preselected temperature, the calibrated setting, an increase in the fluid's vapor pressure results. This increase in vapor pressure induces a force on the diaphragm, causing the diaphragm to snap. This causes the switch contacts 30 to open, creating an open circuit between the lamp 10 and the electrical power source 36. The power to the lamp 10 will remain disrupted until the temperature of the fluid in the capillary tube thermostat drops below a preselected level.

The capillary tube thermostat 20 used in this invention may be a conventional linear capillary tube thermostat. Examples of capillary tube thermostats that may be used are Model Nos. 10H11 (automatic reset) and 10H14 (manual reset) available from Therm-O-Disc, Incorporated, 1320 South Main Street, Mansfield, Ohio 44907-0538. The automatic reset thermostat permits current to be restored to the lamp 10 once the temperature in the vicinity of the thermostat 20 drops below a preselected temperature, and the manual reset device continues to disrupt current flow to the lamp 10 until the temperature in the vicinity of the thermostat 20 drops below a certain preselected temperature and the user manually resets the electrical circuit to the lamp 10 by either pressing a reset button or unplugging the lamp and reconnecting the lamp 10 to the source of electrical power.

The thermal characteristics of the capillary tube thermostat 20 are dependent upon various criteria and, thus, may vary given the desired operating constraints to be imposed on the lighting device. For example, the 10H11 and 10H14 models can be set to open at a temperature rise between 150° F. and 350° F.±15° F. The Model No. 10H11, the automatic reset version, permits resetting of the contacts at approximately 40° F. below the opening temperature. The 10H14, the manual reset thermostat, may automatically reset when exposed to temperatures below −31° F. It will be appreciated that other capillary tube thermostats having opening temperatures in excess of 350° F. may be used, particularly since halogen bulbs may operate at temperatures in excess of 500° F.

There are a variety of configurations that may be employed to fabricate the lighting device 10. Thus, the disclosed embodiments are given to illustrate the invention. However, the disclosed embodiments are not intended to limit scope and spirit of the invention. Therefore, the invention should be limited only by the appended claims.

We claim:

1. A lighting device comprising:

a housing, a bulb received in the housing, the bulb being connected to a source of electrical power, and a capillary tube thermostat supported by the housing in thermal contact with the bulb, wherein the thermostat is in electrical communication with the power source and the thermostat extends along at least a portion of the length of the bulb.

2. The lighting device as defined in claim 1, wherein the bulb is a halogen bulb.

3. The lighting device as defined in claim 2, wherein a shield covers the bulb.

4. The lighting device as defined in claim 1, wherein a guard extends across the bulb to prevent flammable materials form contacting the housing, shield or the bulb.

5. The lighting device as defined in claim 1, wherein the thermostat is filled with a fluid under pressure.

6. The lighting device as defined in claim 5, wherein the thermostat retains a fluid under pressure that is calibrated to open the thermostat between 150° F. and 350° F.

7. The lighting device as defined in claim 1, wherein the thermostat is manually resettable, whereby the lighting device must be disconnected from the power source and reconnected or a manual rest must be depressed to close open thermostat contacts.

8. The lighting device as defined in claim 1, wherein the thermostat is automatically resettable, whereby power is automatically restored to the bulb once a temperature in the vicinity of the bulb drops below a preselected temperature.

9. The lighting device as defined in claim 1, wherein the thermostat has a circular configuration.

10. The lighting device as defined in claim 6, wherein the fluid under pressure is vacuum charged.

11. A lighting device comprising a housing, a reflector supported by the housing, and a light emitting device received within the housing and coupled to an electrical power source, the improvement comprising:

a capillary tube thermostat supported by the housing in thermal contact with a bulb, wherein the thermostat extends along at least a portion of the bulb.

12. The lighting device as defined in claim 11, wherein the thermostat is in thermal contact with the reflector.

13. The lighting device as defined in claim 11, wherein the thermostat is filled with a fluid under pressure, whereby when a preselected temperature is reached the vapor pressure of the fluid increases, causing a movable member in fluid communication with the fluid under pressure to activate a relay or other electrical contact so as to create an open circuit between the bulb and the electrical power source.

14. The lighting device as defined in claim 13, wherein the thermostat has an opening temperature between 150° F. and 350° F.

15. The lighting device as defined in claim 11, wherein the thermostat is Model No. 10H11 available from Therm-O-Disc, Incorporated.

16. The lighting device as defined in claim 11, wherein the thermostat is Model No. 10H14 available from Thermo-O-Disc, Incorporated.

17. The lighting device as defined in claim 11, wherein the thermostat has an opening temperature in excess of 350° F.

* * * * *